US005603223A

United States Patent [19]

Murray et al.

[11] Patent Number: 5,603,223

[45] Date of Patent: Feb. 18, 1997

[54] REFRIGERANT HANDLING WITH LUBRICANT SEPARATION AND DRAINING

[75] Inventors: Walter D. Murray, Pioneer; Gary P. Murray, Montpelier; Kenneth W. Manz, Paulding, all of Ohio

[73] Assignee: SPX Corporation, Muskegon, Mich.

[21] Appl. No.: 582,147

[22] Filed: Jan. 2, 1996

[51] Int. Cl.[6] ..... F25B 43/02

[52] U.S. Cl. ..... 62/84; 62/475; 62/292; 62/85; 62/77; 62/149; 62/470

[58] Field of Search ..... 62/85, 471, 84, 62/475, 292, 77, 149, 470

[56] References Cited

U.S. PATENT DOCUMENTS

| | | | |
|---|---|---|---|
| 4,364,236 | 12/1982 | Lower et al. | 62/292 |
| 4,768,347 | 9/1988 | Manz et al. | 62/149 |
| 4,809,520 | 5/1989 | Manz et al. | 62/292 |
| 4,862,699 | 9/1989 | Lounis | 62/84 |
| 5,042,271 | 8/1991 | Manz | 62/473 |

OTHER PUBLICATIONS

"The Challenge of Recycling" Business News Publishing, 1995 p. 22.

*Primary Examiner*—John M. Sollecito

*Attorney, Agent, or Firm*—Barnes, Kisselle, Raisch, Choate, Whittemore & Hulbert

[57] ABSTRACT

In a refrigerant recovery system, a refrigerant compressor has an inlet for connection to a source of refrigerant to be recovered and an outlet for connection to a refrigerant storage container. A separator is connected in series with the compressor for separating lubricant from refrigerant either before or after passage of the refrigerant through the compressor. A valve or other suitable means is operatively connected between the inlet and outlet of the compressor for equalizing pressure across the compressor during non-operation of the compressor. A pressure sensor is coupled to the refrigerant recovery system and responsive to refrigerant pressure at the lubricant separator. A manual or automatic valve is coupled to a drain on the separator for draining lubricant from the separator during non-operation of the compressor when refrigerant pressure at the separator reaches a selected level during non-operation of the compressor.

20 Claims, 2 Drawing Sheets

REFRIGERANT HANDLING WITH LUBRICANT SEPARATION AND DRAINING

The present invention is directed to refrigerant handling systems, and more particularly to a system and method for separating and draining lubricant from refrigerant passing through the system.

BACKGROUND AND OBJECTS OF THE INVENTION

In refrigerant handling systems, such as refrigerant recovery and/or recycling systems using a compressor, it is conventional to separate lubricant (oil) while transferring the refrigerant. (The term "lubricant" is employed in the broad sense to include both natural and synthetic "oils" and other types of refrigeration system lubricants.) In U.S. Pat. No. 4,768,347 for example, the recovery compressor has its own lubricant sump, and the main or system lubricant separator is located upstream of the compressor inlet in an effort to minimize mixing of the lubricant in the refrigerant being recovered with the compressor lubricant. For service of automotive air conditioning systems and other small refrigeration systems, a lubricant separator such as that disclosed in U.S. Pat. No. 4,809,520 is large enough to hold the entire charge of lubricant collected from the system under service. The collected lubricant is drained through a valve and measured after each recovery operation, so that the same amount of lubricant can be replaced when recharging the refrigeration system under service.

In refrigerant handling systems employing oiled compressors, it is also conventional to provide a separator for recovering and recycling the compressor oil, as disclosed in U.S. Pat. No. 5,042,271. In such systems, there is thus typically a system lubricant separator upstream of the compressor inlet and a compressor lubricant separator downstream of the compressor outlet. It has also been proposed to employ oil-less compressors having no internal oil sump. Some oil-less compressors cannot operate for long periods of time downstream from a very high quality lubricant separator. In such situations, as noted in Manz, *The Challenge of Recycling*, Business News Publishing, 1995, page 22, a single lubricant separator with drain is disposed downstream of the compressor outlet.

In a refrigeration system service environment, there are two concerns regarding the lubricant (oil) separators. First, the service technician should drain the lubricant from the separator following each use of the service system. Otherwise, the purpose of the separator will be defeated when it is over-full. Second, contamination of different refrigerants with different and potentially incompatible lubricants (such as R-12 and PAG lubricant) is a source of concern. In automotive air conditioner service applications, for example, service operators prefer to employ a single unit for servicing both R-12 and R-134a systems. In such units employing a common lubricant separator for both refrigerants, as disclosed for example in U.S. application Ser. No. 08/357,929, potential lubricant contamination is of particular concern. SAE Standard J1770 applicable to combined R-12/R-134a refrigerant service equipment requires an interlock to ensure that lubricant is drained from the separator before clearing the system of one refrigerant and connecting to a system with a different refrigerant.

It is a general object of the present invention to provide a refrigerant handling system and method, particularly a refrigerant recovery system and method for use in a refrigeration system service environment, that facilitate separation and draining of lubricant from refrigerant. A more specific object of the present invention is to provide a system and method of the described character that includes facility for monitoring refrigerant pressure at the lubricant separator, and either manually or automatically draining lubricant from the separator when refrigerant pressure reaches a preselected level. A further object of the present invention is to provide a system and method of the described character having a compressor for pumping refrigerant and a pressure equalization valve connected between the compressor inlet and outlet for equalizing pressure across the compressor during non-operation of the compressor, and in which draining of lubricant at the separator is facilitated by refrigerant pressure during pressure equalization.

SUMMARY OF THE INVENTION

A refrigerant handling system in accordance with the present invention includes a compressor having an inlet and an outlet, and a separator for removing lubricant from refrigerant flowing through the compressor. A pressure sensor is coupled to the system in such a way as to be responsive to refrigerant pressure at the separator. A lubricant drain at the separator is opened, either manually or automatically, when refrigerant pressure at the separator reaches a selected level. In one embodiment, a display is responsive to refrigerant pressure at the separator for indicating to an operator when such refrigerant pressure reaches the selected level, and a valve may be manually opened at that point for draining lubricant from the separator. In another embodiment, the pressure sensor controls operation of a solenoid valve for automatically draining lubricant from the separator responsive to separator refrigerant pressure. The lubricant separator may be connected either upstream of the compressor inlet for separating lubricant from refrigerant prior to passage through the compressor, or downstream of the compressor outlet for separating lubricant from the refrigerant following passage through the compressor.

In a refrigerant recovery system in accordance with the preferred embodiments of the invention, a refrigerant compressor has an inlet for connection to a source of refrigerant to be recovered and an outlet for connection to a refrigerant storage vessel or container. A separator is connected in series with the compressor for separating lubricant from refrigerant either before or after passage of the refrigerant through the compressor. A valve or other suitable means is operatively connected between the inlet and outlet of the compressor for equalizing pressure across the compressor during non-operation of the compressor. A pressure sensor is coupled to the refrigerant recovery system and responsive to refrigerant pressure at the lubricant separator. A manual or automatic valve is coupled to a drain on the separator for draining lubricant from the separator during non-operation of the compressor when refrigerant pressure at the separator reaches a preselected level during non-operation of the compressor. The lubricant separator is connected to either the inlet or the outlet of the compressor, and the equalization valve is connected across the combination of the compressor and the lubricant separator.

BRIEF DESCRIPTION OF THE DRAWINGS

The invention, together with additional objects, features and advantages thereof, would be best understood from the following description, the appended claims and the accompanying drawings in which:

DETAILED DESCRIPTION OF PREFERRED EMBODIMENTS

Figure 1:
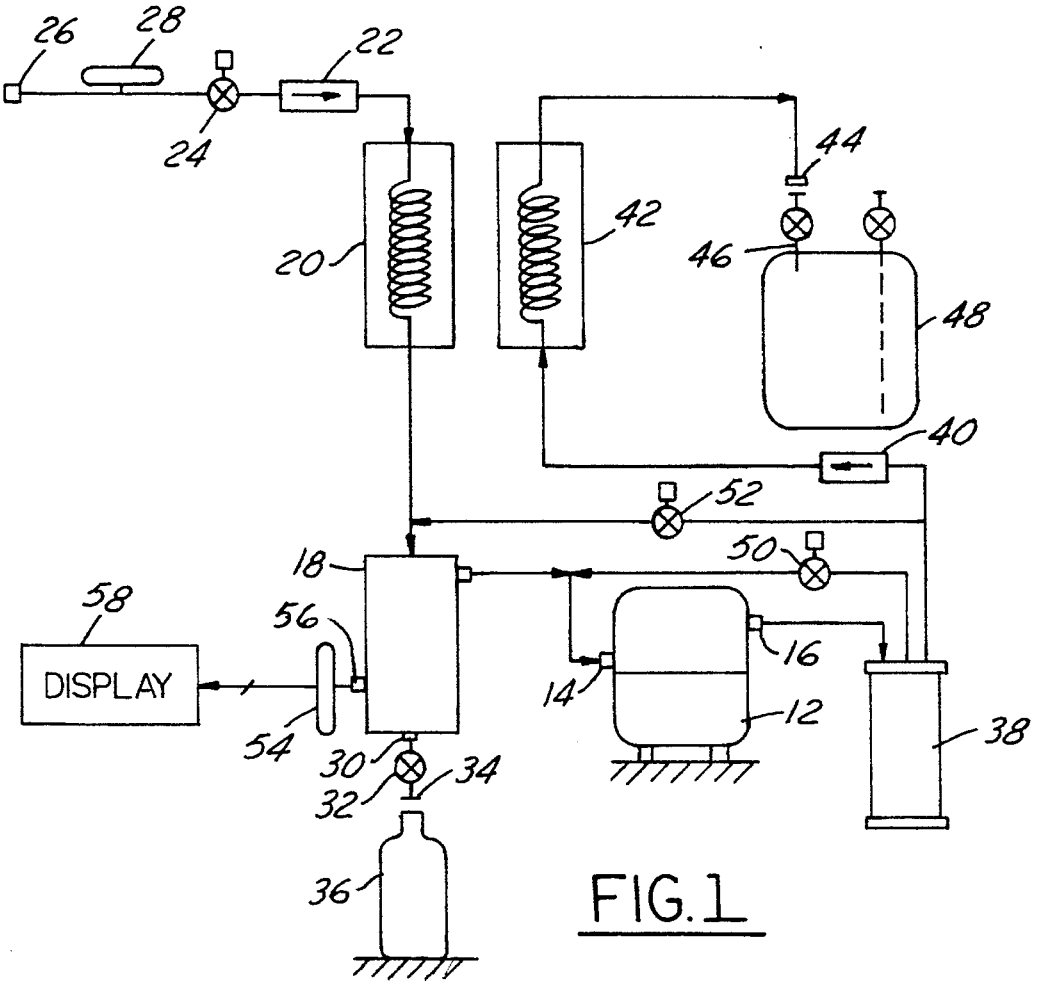
FIG. 1 is a schematic diagram of a refrigerant recovery system in accordance with one presently preferred implementation of the invention.

FIG. 1 illustrates a refrigerant recovery system 10 in accordance with one presently preferred embodiment of the invention as comprising a compressor 12 having an inlet 14 and an outlet 16. Compressor inlet 14 is connected through an oil separator 18, an evaporator 20, a check valve 22 and a recovery control valve 24 to an inlet fitting 26 for connection to a refrigeration system from which refrigerant is to be recovered. An inlet pressure sensor 28 is connected between fitting 26 and solenoid valve 24. Oil separator 18 has a drain 30 connected through a manual valve 32 to a fitting 34 for connection to an oil catch bottle 36. The outlet 16 of compressor 12 is connected through a compressor oil separator 38, a check valve 40 and a condensor 42 to an outlet fitting 44 for connection to the vapor port 46 of a refrigerant storage container 48. Oil separator 38, which may be of a type disclosed in above-noted U.S. Pat. No. 5,042,271, also has a port connected through a solenoid valve 50 (or other suitable means such as a capillary tube) to compressor inlet 14 for returning compressor lubricant to the compressor sump. A solenoid valve 52 is operatively connected between the compressor outlet and the compressor inlet for equalizing pressure across the compressor during periods in which the compressor is not in operation. To the extent thus far described, recovery system 10 is of generally conventional construction as disclosed in the several U.S. patents noted above.

In operation, inlet fitting 26 is connected to a refrigeration system from which refrigerant is to be recovered, solenoid valve 24 is opened, solenoid valves 50, 52 are closed, and operation of compressor 12 is initiated. Refrigerant is withdrawn from the system under service, and is evaporated or super-heated in evaporator 20. (Evaporator 20 may be replaced by an accumulator, or may be eliminated entirely when incoming refrigerant is always in vapor phase. Valve 50 may be opened intermittently for dynamic oil return to the compressor sump.) During passage of the incoming refrigerant through separator 18, lubricant droplets are separated from the refrigerant vapor and fall by gravity to the lower portion of the separator. The refrigerant is pumped through compressor 12 into compressor oil separator 38, at which the compressor oil is separated from the refrigerant and fed back to the compressor inlet through valve 50. The refrigerant vapor is then fed through check valve 40 to condensor 42 in which the refrigerant is wholly or partly condensed to liquid phase, and then through outlet fitting 44 to vapor port 46 of storage container 48. When pressure sensor 28 indicates that all refrigerant has been recovered from the system under service, valves 24, 50 are closed, compressor 12 is turned off, and valve 52 is opened to equalized pressure across the compressor. Valve 32 may be manually opened by an operator at this time to drain lubricant from separator 18.

Figure 2:
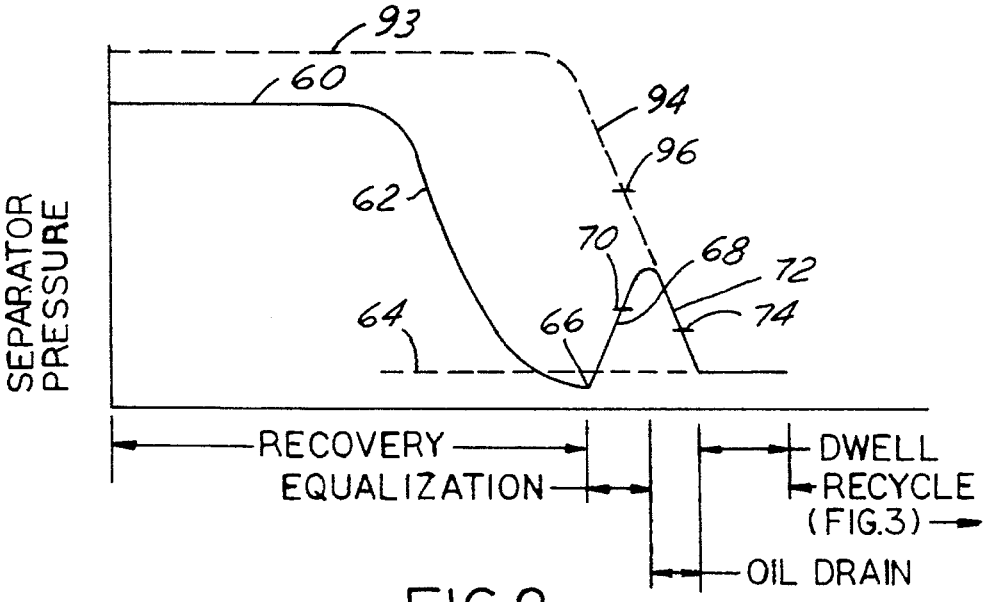
FIG. 2 is a graph illustrating refrigerant pressure at the lubricant separator in the system of FIG. 1 (and the system of FIG. 3) during various modes of operation.

In accordance with the present invention, equalization valve 52 is operatively connected across the series combination of lubricant separator 18 and compressor 12. A pressure sensor 54 is connected to refrigerant recovery system 10, such as at a port 56 of separator 18, so as to be responsive to pressure of refrigerant within the lubricant separator. Pressure sensor 54, which may comprise a pressure switch having one or more set or adjustable thresholds (two thresholds 70, 74 are illustrated in FIG. 2), is connected to an operator display 58, either directly or through suitable drive electronics. FIG. 2 is a graph that illustrates pressure at sensor 54 versus time (not to scale) during various system modes of operation. Initially, upon initiation of a refrigerant recovery mode of operation, refrigerant inlet pressure is relatively high as at 60, and begins to decrease as at 62 as refrigerant is drawn from the system under service. As further refrigerant has recovered from the system under service, the pressure within separator 18 continues to fall beneath atmospheric pressure 64 to some relatively low level at 66 at which sensor 28 terminates the recovery mode of operation. Power is removed from compressor 12, either immediately or after a time delay to clear evaporator (or accumulator) 20. At this point, as noted above, equalization valve 52 is opened, and refrigerant pressure at separator 18 begins to increase as at 68.

During this equalization mode of operation, when the refrigerant pressure at separator 18 reaches the preselected level 70, sensor 54 operates display 58, which may comprise a visual and/or audio display, to advise the operator to open valve 32. (Valve 32 in this embodiment may comprise either a manual valve or a solenoid valve operated by a manual switch.) Pressure threshold level 70 preferably is above atmospheric pressure 64, as illustrated in FIG. 2, so that the pressure of refrigerant within separator 18 assists the force of gravity in draining lubricant from separator 18 through valve 32 into bottle 36. Since the system is thus open to atmosphere through valve 32, pressure at sensor 18 begins to decrease as at 72. When the pressure within separator 18 decreases to the second threshold level 74, still greater than atmospheric pressure 64, the operator is advised at display 58 to close valve 32. The system then enters a dwell mode of operation preparatory to either another refrigerant recovery mode of operation, or a refrigerant clearing mode of operation as disclosed in U.S. Pat. Nos. 5,095,713 and 5,127,239.

Figure 3:
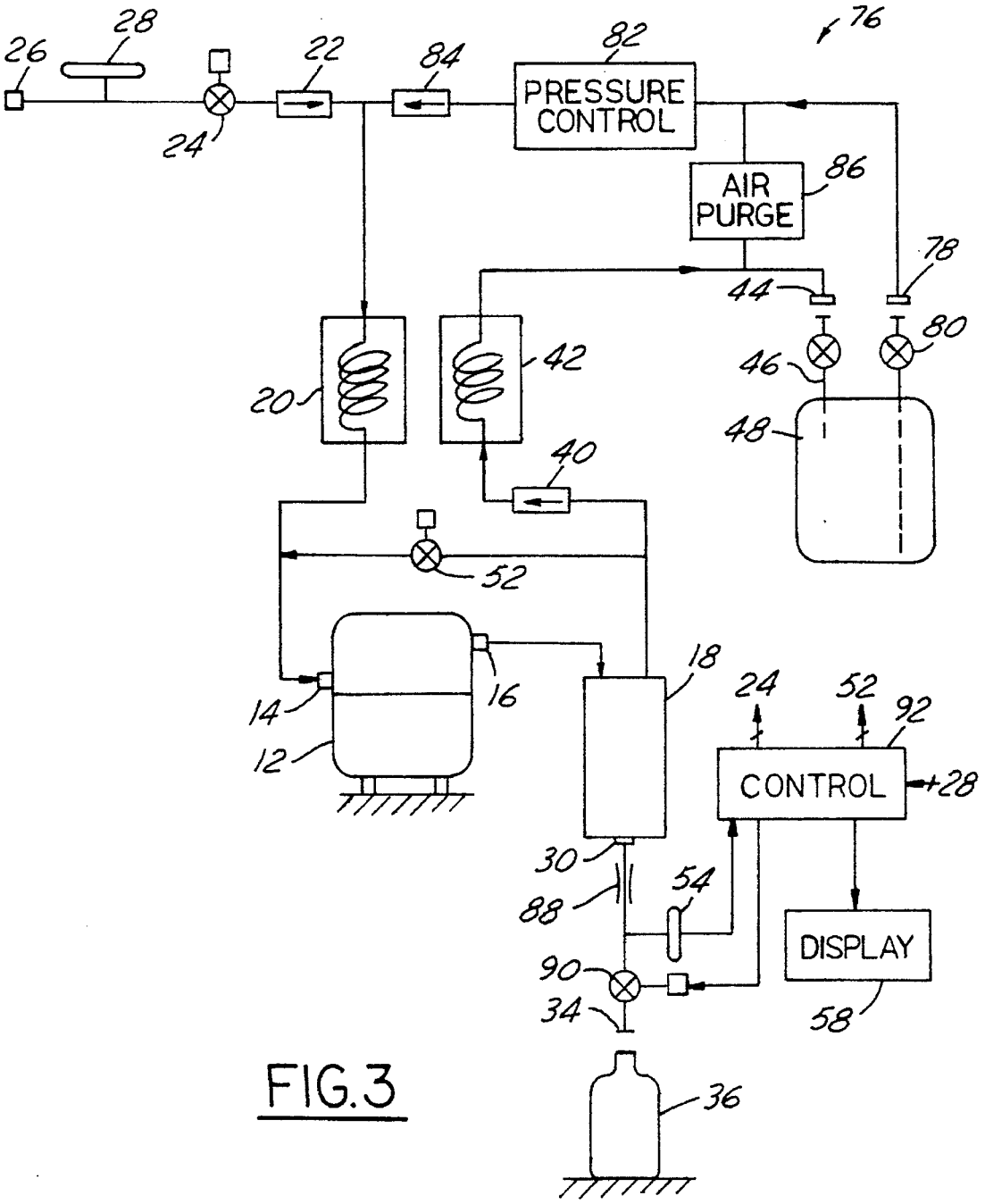
FIG. 3 is a schematic diagram of a refrigerant recovery and recycling system in accordance with another presently preferred embodiment of the invention.

FIG. 3 illustrates a refrigerant recovery/recycling system 76 in accordance with a modified embodiment of the invention. Identical reference numerals are employed to indicate identical components in FIGS. 1 and 3. System 76 in FIG. 3 is particularly useful in conjunction with oil-less compressors 12, with system oil separator 18 being disposed downstream of compressor 12 rather than upstream of compressor 12 as in FIG. 1. System 76 also has a recycle inlet fitting 78 for connection to the liquid port 80 of refrigerant storage container 48. Recycle inlet fitting 78 is connected through a pressure control 82 and a check valve 84 to the inlet of evaporator 20. Recycling operation for purification of refrigerant within container 48 is fully described in above-noted U.S. Pat. No. 4,805,416. An air purge control 86 is connected between fittings 44, 78, and may be of a type disclosed in any of U.S. Pat. Nos. 5,005,369, 5,063,749, 5,181,391 and 5,285,647, or in U.S. application serial No. 08/316,260.

Drain port 30 of separator 18 is connected to fitting 34 through the series combination of an orifice 88 and a solenoid valve 90. Pressure sensor 54 is connected between orifice 88 and valve 90, and is responsive to separator pressure through the orifice. Lubricant separator pressure sensor 54 is connected in FIG. 3 to an electronic control module 92, which also receives inputs from pressure sensor 28 and from operator control switches (not shown) for controlling system operation. Control module 92 has outputs connected to operator display 58 and solenoid valve 90.

Inasmuch as separator 18 and sensor 54 are connected to the high-pressure side of compressor 14 in system 76 (FIG. 3), pressure at sensor 54 is initially higher during the recovery mode of operation, as at 93 in FIG. 2. Following termination of the recovery mode of operation, and during the mode of operation in which pressure across compressor 12 is equalized by opening valve 52, pressure at sensor 54 decreases as at 94. When the pressure reaches the threshold level 96, again greater than atmospheric pressure 64, valve 90 is automatically opened by operation of control electronics 88 (or otherwise manually opened) so that lubricant captured within separator 18 drains into catch bottle 38. Solenoid valve 90 is closed when pressure at sensor 54 reaches level 74, and pressure across compressor 12 is again stabilized at atmospheric pressure. After a suitable dwell, a recycling mode of operation may be automatically initiated by control electronics 88. A clearing mode of operation, as disclosed in above-noted U.S. Pat. No. 5,095,713 and 5,127,239, may be initiated either after or in lieu of a recycling mode of operation to prepare system 76 for use in conjunction with a differing type of refrigerant. Orifice 88 functions to lower the outlet port pressure more quickly when the lubricant has been removed, and thus helps prevent loss of refrigerant. The embodiment of FIG. 3 may also be employed during a cleaning mode of operation, in which event operation will be analogous to 60, 62, 64, 66, 68, 70, 72 and 74 in FIG. 2.

The present invention seeks to assure that oil is drained after each recovery operation, and not after a recycle or clearing operation. Indeed, in partially or in fully automated systems, interlocks may be employed to assure that a recycling or clearing mode of operation is not entered until oil is drained. Pressure switch 54 provides information to guide the oil drain cycle by indicating that a recovery cycle has just been completed, involving pattern recognition of sensed pressure by an operator or control electronics and condition sensing relative to specific pressure threshold levels. If pressure did not fall below threshold 74 during the last drain cycle, the operator may be so advised and/or further operation inhibited. Proper completion of an oil drain cycle, again involving recognition of the pressure pattern illustrated in FIG. 2 as well as sensing pressure drop to level 74, would enable further operation.

We claim:

1. In a refrigerant handling system that includes a compressor having an inlet and an outlet, and means for separating lubricant from refrigerant flowing through said compressor, means for draining lubricant from said separating means comprising:

means operatively connected between said inlet and said outlet of said compressor for equalizing pressure across said compressor during non-operation of said compressor, means coupled to said system and responsive to refrigerant pressure at said separating means, and means, operable during operation of said pressure equalizing means and during non-operation of said compressor, for employing pressure of refrigerant at said separating means to drain lubricant from said separating means when refrigerant pressure at said separating means reaches a selected level.

2. The system set forth in claim 1 wherein said draining means comprises display means responsive to said pressure-responsive means for indicating to an operator when refrigerant pressure at said lubricant-separating means reaches said selected level, and means coupled to said separating means and responsive to an operator for draining lubricant from said separating means.

3. The system set forth in claim 2 wherein said operator-responsive means comprises valve means coupled to a drain port of said separating means and responsive to manual activation by an operator.

4. The system set forth in claim 1 wherein said lubricant-draining means comprises means coupled to said lubricant-separating means and responsive to said pressure-responsive means for automatically draining lubricant from said lubricant-separating means when said refrigerant pressure reaches said selected level.

5. The system set forth in claim 4 wherein said automatically draining means includes a solenoid valve coupled to a drain port of said separating means.

6. The system set forth in claim 1 wherein said lubricant-separating means is coupled to said compressor inlet for separating lubricant for refrigerant prior to passage of the refrigerant through said compressor.

7. The system set forth in claim 1 wherein said lubricant-separating means is coupled to said compressor outlet for separating lubricant from refrigerant after passage of the refrigerant through said compressor.

8. The system set forth in claim 1 wherein said draining means comprises orifice means coupled between a drain port on said separating means and said pressure-responsive means for controlling rate of change of pressure at said pressure-responsive means and loss of refrigerant through said draining means.

9. A refrigerant recovery system that comprises:

a refrigerant compressor having an inlet for connection to a source of refrigerant to be recovered and an outlet for connection to refrigerant storage means, means for separating lubricant from refrigerant either before or after passage of the refrigerant through said compressor, means operatively connected between said inlet and said outlet of said compressor for equalizing pressure across said compressor during non-operation of said compressor, means disposed at a preselected location in said system and responsive to refrigerant pressure at said lubricant-separating means, and means coupled to said lubricant-separating means for draining lubricant from said separating means during non-operation of said compressor when refrigerant pressure at said separating means reaches a selected level.

10. The system set forth in claim 9 wherein said lubricant-separating means is connected either upstream or downstream of said compressor, and wherein said valve means is connected across the combination of said compressor and said lubricant-separating means.

11. The system set forth in claim 9 wherein said draining means comprises display means responsive to said pressure-responsive means for indicating to an operator with refrigerant pressure at said lubricant-separating means reaches said selected level, and means coupled to said separating means and responsive to an operator for draining lubricant from said separating means.

12. The system set forth in claim 9 wherein said lubricant-draining means comprises means coupled to said lubricant-separating means and responsive to said pressure-responsive means for automatically draining lubricant from said lubricant-separating means when said refrigerant pressure reaches said selected.

13. The system set forth in claim 9 wherein said draining means comprises orifice means coupled between a drain port on said separating means and said pressure-responsive means for controlling rate of change of pressure at said pressure-responsive means and loss of refrigerant through said draining means.

14. A method of separating lubricant from refrigerant comprising the steps of:

(a) providing a compressor for pumping refrigerant from an inlet to an outlet during operation of said compressor, (b) connecting a lubricant separator either upstream or downstream of said compressor for separating lubricant from refrigerant during operation of said compressor either prior to or following passage of the refrigerant through said compressor respectively, (c) equalizing pressure between said inlet and said outlet during non-operation of said compressor, (d) monitoring pressure at said lubricant separator during non-operation of said compressor, and (e) draining lubricant from said separator during non-operation of said compressor when pressure monitored in said step (d) reaches a preselected level.

15. The method set forth in claim 14 wherein said step (e) is carried out automatically.

16. The method set forth in claim 14 wherein said step (e) is carried out manually.

17. The method set forth in claim 14 comprising the additional step of:

(f) inhibiting further operation of said compressor until said step (e) has been completed.

18. A method of recovering refrigerant from refrigeration equipment under service that comprises the steps of:

(a) connecting a compressor and a lubricant separator to the equipment under service, (b) operating said compressor to pump refrigerant from the equipment under service through said separator to separate lubricant therefrom, (c) following completion of said step (b), equalizing pressure across said compressor and separator during non-operation of said compressor, and (d) during said step (c), monitoring pressure within said separator and draining lubricant from said separator when pressure within said separator reaches a preselected threshold.

19. The method set forth in claim 18 comprising the additional step of:

(e) inhibiting further operation of said compressor until said step (d) has been completed.

20. The method set forth in claim 18 wherein said step (d) comprises the steps of:

(d1) opening a drain port on said separator when pressure within said separator reaches a first preselected threshold greater than atmospheric pressure, and (d2) closing said drain port on said separator when pressure within said separator reaches a said second preselected threshold less than said first threshold but still greater than atmospheric pressure.

* * * * *